United States Patent [19]

Tardiff

[11] Patent Number: 4,664,387

[45] Date of Patent: May 12, 1987

[54] PRACTICE PUTTING BALL

[76] Inventor: George E. Tardiff, 1504 Wetmore Rd., Livermore, Calif. 94550

[21] Appl. No.: 819,215

[22] Filed: Jan. 14, 1986

[51] Int. Cl.[4] ..... A63B 69/36

[52] U.S. Cl. ..... 273/183 C; 273/58 K

[58] Field of Search ..... 273/183 C, 199 R, 213, 273/59 B, 58 K, 58 A, 199 A, 128 A

[56] References Cited

U.S. PATENT DOCUMENTS

| | | | |
|---|---|---|---|
| 2,331,605 | 7/1943 | Special | 273/213 |
| 2,709,595 | 5/1955 | DeVries | 273/183 C |
| 2,884,254 | 4/1959 | Miner | 273/183 C |
| 3,753,565 | 8/1973 | Baker | 273/213 X |
| 3,796,435 | 3/1974 | Dale | 273/199 R X |
| 4,181,302 | 1/1980 | Sexton et al. | 273/DIG. 020 |
| 4,278,254 | 7/1981 | Simjian | 273/183 C |
| 4,494,757 | 1/1985 | Simjian | 273/183 C |

FOREIGN PATENT DOCUMENTS

| | | | |
|---|---|---|---|
| 179444 | 5/1922 | United Kingdom | 273/59 B |

*Primary Examiner*—George J. Marlo
*Attorney, Agent, or Firm*—Thomas Schneck

[57] ABSTRACT

A practice putting device in which a golf ball has two equal and one smaller mutually orthogonal principle mass moments of inertia. The center of mass is in the center of the ball. Weights, such as metal shapes denser than the ball are embedded on diametrically opposite sides of the ball. The center of gravity of each weight and the center of the ball are coincidental with the axis of rotation corresponding to the smallest of the moments of inertia. The product of the square of the distance of the center of gravity of each weight from the center of the ball and the magnitude of each weight (i.e., $r_{cg}^2 \times W$) is between 0.005 and 0.05 $in^2$-lb. Thus, the weights will tend to align this axis of rotation perpendicularly to a second axis of rotation if the ball is caused to rotate about the second axis. When the ball is stroked properly with a line through the center of the weights parallel to the putting surface and perpendicular to the intended path of the ball, the ball will roll straight without wobble. When misstroked, the ball will be dynamically unstable and will roll with an increasing wobble. A stripe or line or printing may be provided on the ball for indicating proper alignment.

12 Claims, 5 Drawing Figures

PRACTICE PUTTING BALL

DESCRIPTION

1. Technical Field

The present invention relates to golf balls and in particular to golf balls for use in the practice and improvement of putting skills.

2. Background Art

Putting skill is a most important aspect of golf and in many instances is decisive as to whether an excellent or a poor score is achieved. Great effort is made by both professional and amateur players to improve the skill of putting.

Most putting practice is a time consuming trial and error process where a golf ball is repetitively putted a short distance toward a marker or cup. Often, it is very difficult to determine when one has correctly stroked the ball, because in any particular instance two or more errors may tend to compensate. For example, a player may misalign the putter but make a successful putt anyway because the ball was stroked improperly. If the ball is stroked properly, it should roll forwardly from the club head, and each point on the surface of the ball should remain in a plane parallel to the intended path of the ball. The ball will roll straight and turn about an axis perpendicular to the direction of travel. It is difficult to determine, however, by visual observation of the rolling ball whether this condition exists.

In Miner U.S. Pat. No. 2,884,254, a practice golf ball has two visual indicator projections extending from opposite sides of the ball in axial alignment. In use, the ball is positioned on the putting surface with the projections parallel to the putting surface and perpendicular to the intended path of the ball. If the ball is then stroked correctly, the ball will roll along the surface with the projections remaining at all times parallel to the putting surface. If the ball is improperly stroked, the projections will give a clear indication of this by wobbling, i.e. tracing cones of revolution as the ball rolls.

In DeVries U.S: Pat. No. 2,709,595, a practice golf ball has a thin circumferential stripe on its surface. The apparent width of this stripe on a rolling ball indicates the deviation of the ball from its intended path.

For all but the shortest putts, even slight misstrokes may cause the ball to miss the cup. Prior art practice golf balls have devices which do not affect the motion of the ball, and which do not strongly indicate small misstrokes. For small misstrokes, the wobble of projections or change in stripe width is not a strong indicator of the misstroke. Thus, it is desirable that improvements be made so that even slight misstrokes become apparent. One approach to this end is described in Simjian U.S. Pat. Nos. 4,278,254 and 4,494,757. In these practice putting devices, wheels are attached to the golf ball or two or more balls are connected together. If the wheels or the outer balls of the multiple ball assembly are not struck simultaneously, the device will take an erratic path relative to the intended direction of travel.

An object of the present invention is to provide a practice putting ball which will give a strong indication of a small misstroke.

Another object of the invention is to retain the form of the normal golf ball in the striking zone so that practice is as similar to putting with a normal golf ball as possible.

Another object of the invention is to provide a set of practice balls with different sensitivities to misstrokes to allow a golfer to select the ball appropriate to his level of skill.

DISCLOSURE OF INVENTION

The above objects have been met with a dynamically reactive golf practice putting device in which a golf ball or golf ball-like spherical ball has three principle mass moments of inertia about three corresponding mutually orthogonal axes, two of the moments being equal, the third moment being smaller than the other two. Thus, although the ball has a center of mass that coincides with the center of ball, the roll of ball can be stable or dynamically unstable. When struck squarely with the axis corresponding to the smaller moment parallel to the putting surface and perpendicular to the intended path, the ball will move in a stable manner with the axis of rotation coincident with the axis of the smaller mass moment of inertia. When the ball is misstroked, i.e., not struck squarely, it will roll unstably as the low mass moment of inertia axis attempts to align itself perpendicularly to the rolling axis. It is this dynamic reaction of the misstroked ball which leads to the dramatic effect that even small misstrokes have on the motion of the ball.

The required moment of inertia properties are provided by weights, substantially denser than the ball, which are embedded on diametrically opposite sides of the ball. The centers of gravity of the weights are placed on a line through the center of the ball at equal distances from the center of the ball. This line is the axis corresponding to the smaller moment of inertia. The distance of the weights from the center of the ball and the size, shape and density of the weights can be varied among different balls to provide different sensitivities to misstrokes and other desirable characteristics.

BEST MODE OF CARRYING OUT THE INVENTION

Figure 1A:
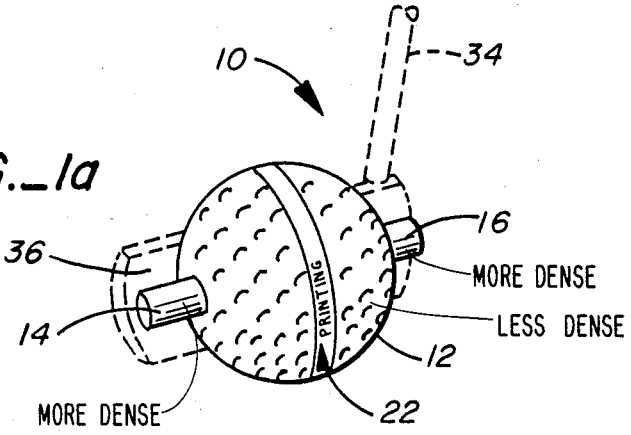
FIG. 1*a* is a perspective view of the practice golf ball of FIG. 1.
Figure 1:
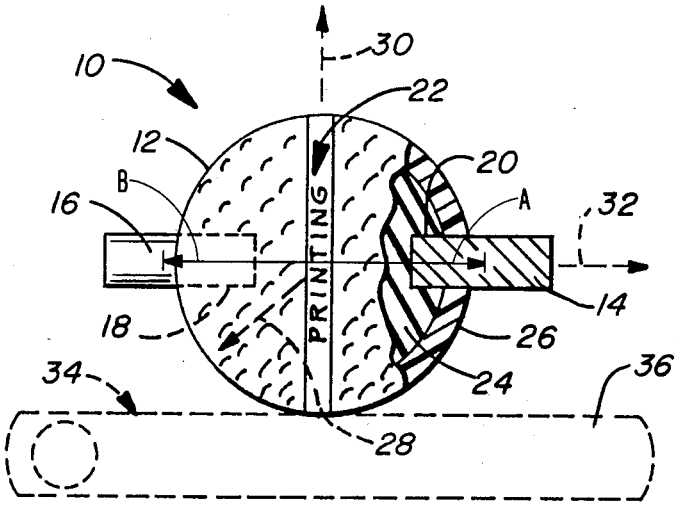
FIG. 1 is a partially cutaway top plan of one embodiment of the practice golf ball of the present invention.

With reference to FIGS. 1 and 1*a*, a practice putting ball 10 comprises a golf ball 12 and two weights 14 and 16. Golf ball 12 is generally spherical with a diameter and surface approximately that of a regulation golf ball. Regulation golf balls must have a minimum diameter of 1.68 inches (4.27 cm) and are usually built with numerous small pits or dents in their surfaces. Regulation golf balls also are required to have a maximum weight of 1.62 ounces (45.9 g), but the practice putting balls 10 of this invention need not meet this requirement. Typically, golf ball 12 has a core 24 of elastic material and a tough cover 26 made of plastic. Typically, the weights 14 and 16 are a pair of equally massive metal slugs, as shown here, but in any case are substantially denser than golf ball 12. The density of a typical golf ball is about 1.1 or 1.2 grams per cubic centimeter. Weights 14 and 16 have a density greater than 4 g/cm$^3$. Examples of appropriate weight materials are brass (density=8.5 g/cm$^3$) and steel (density=7.8 g/cm$^3$). Other high density materials such as iron, copper, zinc, lead, nickel, tungsten, tantalum or their alloys may be used. High density materials, such as brass, produce balls 10 which are generally more sensitive to misstrokes than lower density materials, such as steel.

Weights 14 and 16 are embedded in golf ball 12 in cavities 18 and 20. The weights or slugs may be completely embedded or may project from the surface of golf ball 12. Cavities 18 and 20 are located on diametrically opposite sides of golf ball 12. Cavities 18 and 20 are typically made by drilling into preformed golf balls. Cavities are preferably cylindrical in shape, but may also be some other shape. Cavities must be sized to properly secure the weights and allow the necessary sensitivity to a misstroke to be achieved. Cavities have a characteristic diameter, measured for example on the base of the cylinder and also have a characteristic depth from the surface of the ball to the centermost point of the cavity, i.e. the point closest to the center of ball 12. Cavities 18 and 20 have diameters which can range from 0.1 inch to 1.0 inch and have depths which can range from 0.1 inch to the center of the ball. Weights 14 and 16 are secured within the cavities and positioned so that the center of mass of the weights 14 and 16, and consequently that of the entire practice putting ball 10, is coincident with the center of the golf ball 12. Two equally massive slugs 14 and 16 would be located equidistant from the center of the ball. Slugs 14 and 16 conform to the cavity and have a diameter equal to the diameter of the corresponding cavity and lengths which can vary from 0.1 inch and 2.0 inches. Thus, the slugs 14 and 16 may vary from being completely embedded to projecting 1.25 inches from the surface of golf ball 12. The further the slugs project, other things being the same, the more sensitive the practice putting balls 10 are to misstrokes.

A stripe 22 indicates the orientation of the ball and the direction of the axis through weights 14 and 16. The stripe 22 is of a color contrasting with the remaining surface portions of golf ball 12 and forms a great circle in a diametrical plane intersecting ball 12 normal to the axis 32 through weights 14 and 16. Alternatively, a line of printing may be used in place of stripe 22. Stripe 22 is particularly important when weights 14 and 16 are completely embedded, so that the ball can be properly positioned on the surface, so the putter can be properly aligned and so the roll instability can be seen.

Practice putting ball 10 has three principle mass moments of inertia. These moments correspond to rotation about mutually orthogonal axes 28, 30 and 32. Axes 28 and 30 extend through the center of golf ball 12 and through stripe 22. The moments of inertia corresponding to these axes are equal. Rotation about axes 28 and 30 occurs only when a ball 10 is initially misaligned with a putter 34 or misstroked. Axis 32 extends through the center of golf ball 12 and through weights 14 and 16. Since the mass of weights 14 and 16 lie on or close to axis 32, the moment of inertia corresponding to rotation about this axis is smaller than the other two moments. The sensitivity to a misstroke is proportional to $r_{cg}^2 \times W$, where $r_{cg}$ is the distance of the center of gravity of each weight to the center of the ball (shown by Arrows A and B) and W is the magnitude of the weight. $r_{cg}^2 \times W$ is proportional to the torque acting on the misstroked ball which tends to cause the low moment of inertia axis 32 to align itself perpendicularly to the rolling axis. Tests carried out to determine the required $r_{cg}^2 \times W$ to produce the appropriate sensitivity to a misstroke show that this parameter must lie between 0.005 in$^2$-lb and 0.05 in$^2$-lb. Below 0.005, the ball is not sufficiently sensitive to a small misstroke to be useful for putting practice. Above 0.05 the ball is so sensitive as to be impractical for putting practice. Tests also show that an $r_{cg}^2 \times W$ value equal to 0.017 in$^2$-lb results in a sensitivity appropriate for a ball used by the average golfer for putting practice on smooth surfaces.

In operation, a practice putting ball 10 is aligned with axis 32 parallel to the putting surface and perpendicular to the desired direction of motion. A putter 34 should strike ball 10 so that the horizontal line across the face 36 of the club head 34 through the point where the club meets the ball 10 is, at the moment of impact, in a plane perpendicular to the intended path of the ball. Moreover, it is important that the direction of movement of the club head 34, at the moment of impact, be along a path lying in the same vertical plane as the intended path of the ball 10. The club head 34 may have a slight upward movement, inparting a forward rolling motion to the ball 10. If the practice putting ball 10 is correctly stroked, it will roll straight about axis 32 in a stable manner. If practice putting ball 10 is misstroked, some rotation will be imparted about axes 28 and 30. The ball 10 will roll unstably, discernible as weights 14 and 16 begin to bump on the putting surface as the low moment of inertia axis 32 tends to align itself perpendicularly to the rolling axis.

Figure 2:
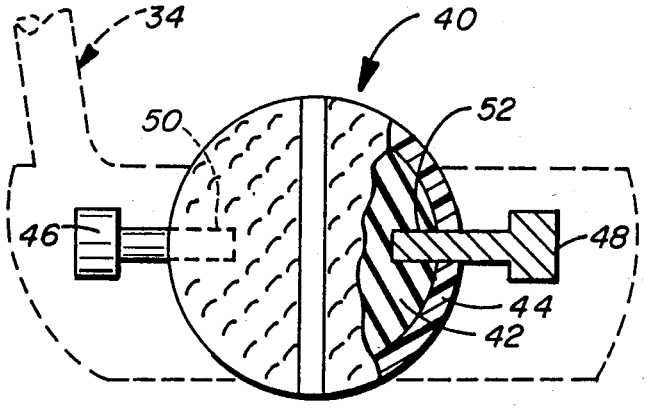
FIG. 2 is a partially cutaway side view of a second embodiment of the present invention.

In FIG. 2, a practice putting ball 40 has a core 42, a cover 44, and shaped weights 46 and 48 embedded in cavities 50 and 52. Practice ball 40 can have the same sensitivity to a misstroke as practice ball 10 in FIG. 1, but the weights 46 and 48 are shaped with heads so that the center of mass is further from the center of the ball and thus the required value of the parameter $r_{cg}^2 \times W$ is achieved with a smaller total weight addition to the ball. This is desirable so that the weight of the practice ball is closer to the weight of an unaltered ball. For example, for the same sensitivity to a misstroke, the weights added to ball 40 in FIG. 2 would weigh more than 25% less than the weights added to ball 10 in FIG. 1.

Figure 3:
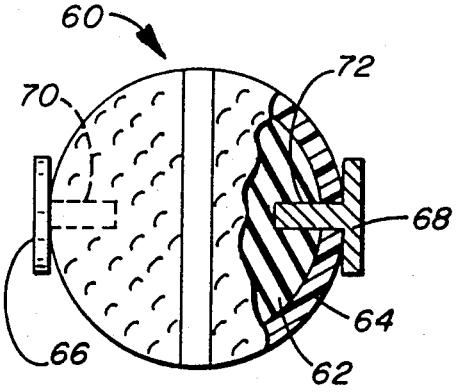
FIG. 3 is a partially cutaway top or side view of a third embodiment of the present invention.

In FIG. 3, a practice putting ball 60 has a core 62, a cover 64, and weights 66 and 68 shaped with heads and embedded in cavities 70 and 72. Practice putting ball 60 can have the same sensitivity to a misstroke as practice ball 10 in FIG. 1 and practice ball 40 in FIG. 2, but the weights 66 and 68 are sized so that the heads are positioned tangentially to the surface of the ball and extend only a small distance from the surface of the ball. A misstroke of ball 60 results in an unstable roll with the ball soon rolling onto its side weights or heads producing a very pronounced tumbling effect. Thus, the effect of a misstroke is most dramatically indicated in the case of practice ball 60.

Figure 4:
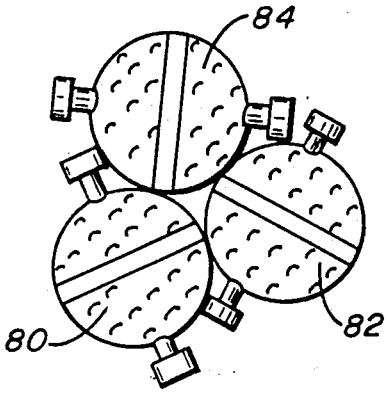
FIG. 4 is a perspective view of a set of practice golf balls of the present invention.

In FIG. 4, a set of different practice balls 80, 82 and 84 are seen. Practice ball 80 has side weights right up against the ball and is least sensitive to misstrokes. Practice balls 82 and 84 have weights which project further from the side of the ball. Practice ball 82 is more sensitive to misstrokes, i.e. will become dynamically unstable with smaller misstrokes than practice ball 80. Ball 84 has the greatest sensitivity to misstrokes and will become dynamically unstable with the smallest misstroke. Alternatively, the set of practice balls 80, 82 and 84 may have weights which vary in density from one ball to another, or have combination of both density and shape variations to provide different sensitivities to misstrokes.

To practice putting with the set in FIG. 4, a golfer selects a practice putting ball 80, 82, or 84 which fits his level of putting skill. For example, a golfer may select a ball which he can correctly stroke without discernible wobble about half of the time. As a golfer becomes proficient with a ball of a particular sensitivity to misstrokes he can switch to a ball with a greater sensitivity. In this manner, a golfer can significantly improve his putting skills.

I claim:

1. A golf practice putting device comprising, a spherical ball having a diameter and a surface approximately that of a regulation golf ball, said ball having three principal mass moments of inertia about three corresponding mutually orthogonal axes, two of said moments being equal, the other of said moments being substantially smaller than the two equal moments, said ball having a center of mass coinciding with the center of said ball, and a pair of weights positioned on diametrically opposite sides of said ball corresponding to the axis of the smaller moment, said weights having a density greater than that of said spherical ball, the product of the square of the distance of the center of gravity of each weight from the center of the ball and the magnitude of each weight ($r_{cg}^2 \times W$) being from 0.005 and 0.05 $in^2$-lb.

2. The device of claim 1 wherein said weights have a portion embedded in said ball and a portion projecting from the surface of said weight, said weights having a density greater than 4 $gm/cm^3$.

3. The device of claim 2 wherein said weights comprise a pair of equally massive metal shapes, said metal shapes being equidistant from the center of the ball.

4. The device of claim 3 wherein said weights are shaped with heads.

5. The device of claim 4 wherein said heads are positioned tangentially to the surface of the ball.

6. A practice putting ball comprising, a golf ball having a pair of cavities on diametrically opposite sides in a surface thereof and having the characteristics of a regulation golf ball, and a pair of weights secured within said cavities, said weights being substantially denser than said golf ball, the center of mass of said weights being coincident with the center of said golf ball to form a first axis of ball rotation, the product of the square of the distance of the center of gravity of each weight from the center of the ball and the magnitude of each weight ($r_{cg}^2 \times W$) is in a range from 0.005 and 0.05 $in^2$-lb, whereby said weights tend to align said first axis of ball rotation perpendicularly to a distinct axis of ball rotation when said golf ball is caused to roll about said distinct axis.

7. The practice putting ball of claim 6 wherein said weights are made of a material having a density greater than four grams per cubic centimeter.

8. The practice putting ball of claim 6 wherein said weights project from the surface of said golf ball.

9. The practice putting ball of claim 8 wherein said weights are shaped so as to have heads on projecting ends thereof.

10. The practice putting ball of claim 9 wherein said heads are positioned tangentially to the surface of the ball.

11. A practice putting ball comprising, a regulation golf ball having a core of elastic material and an outer cover, said golf ball having a pair of cavities on diametrically opposite sides in a surface thereof, and a pair of identical metal shaped weights embedded within said cavities, the weights being substantially denser than said golf ball, the center of mass of said weights being coincidental with the center of the golf ball, each of said weights being equidistant from the center of said golf ball, the product of the square of the distance of the center of gravity of each weight from the center of the ball and the magnitude of each weight ($r_{cg}^2 \times W$) is in a range from 0.005 and 0.05 $in^2$-lb.

12. The practice putting ball of claim 11 wherein said weights are made of a material having a density greater than four grams per cubic centimeter.

* * * * *